US008987186B2

(12) United States Patent
Zander et al.

(10) Patent No.: US 8,987,186 B2
(45) Date of Patent: Mar. 24, 2015

(54) REUSABLE DRYER PRODUCTS WITH END-OF-LIFE INDICATORS AND METHODS FOR FABRICIATING SUCH REUSABLE DRYER PRODUCTS

(71) Applicant: The Dial Corporation, Scottsdale, AZ (US)

(72) Inventors: Tasha Zander, Phoenix, AZ (US); Jeffrey Bankers, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 0 days.

(21) Appl. No.: 13/845,165

(22) Filed: Mar. 18, 2013

(65) Prior Publication Data

US 2014/0274869 A1 Sep. 18, 2014

(51) Int. Cl.

| | |
|---|---|
| ***C11D 17/00*** | (2006.01) |
| ***C11D 17/04*** | (2006.01) |
| ***C11D 1/62*** | (2006.01) |
| ***C11D 3/50*** | (2006.01) |

(52) U.S. Cl.

CPC ..... *C11D 17/047* (2013.01); *C11D 1/62* (2013.01); *C11D 3/50* (2013.01)

USPC ..... 510/519

(58) Field of Classification Search

USPC ..... 510/519

See application file for complete search history.

(56) References Cited

U.S. PATENT DOCUMENTS

| | | | | |
|---|---|---|---|---|
| 2005/0192206 | A1* | 9/2005 | O'Brien et al. | 510/520 |
| 2007/0203044 | A1* | 8/2007 | Zhu et al. | 510/293 |
| 2007/0244029 | A1* | 10/2007 | Lentsch et al. | 510/519 |
| 2008/0004204 | A1* | 1/2008 | Tindel-Koukal et al. | 510/517 |

* cited by examiner

*Primary Examiner* — John Hardee
(74) *Attorney, Agent, or Firm* — Thomas G. Krivulka

(57) ABSTRACT

Dryer products for imparting desired properties onto fabric during multiple drying cycles in laundry dryers and methods for fabricating dryer products are provided herein. In one embodiment, a dryer product is provided for use during multiple drying cycles in a laundry dryer and includes a solid body comprising a polymeric material. The dryer product further includes an active compound in and/or on the solid body. The dryer product is configured to release the active compound during a selected number of drying cycles at a temperature of from about 40° C. to about 100° C. The solid body is configured to fray after the selected number of drying cycles to indicate end-of-life.

20 Claims, 3 Drawing Sheets

REUSABLE DRYER PRODUCTS WITH END-OF-LIFE INDICATORS AND METHODS FOR FABRICIATING SUCH REUSABLE DRYER PRODUCTS

TECHNICAL FIELD

The technical field relates dryer products and methods for fabricating dryer products, and more particularly relates to reusable dryer products with end-of-life indicators and methods for fabricating reusable dryer products with end-of-life indicators for use in laundry dryers.

BACKGROUND

Dryer products are commonly used in automated commercial and residential dryers to impart a fragrance onto, or to eliminate static electricity from, fabric dried in the dryers. Conventional dryer products include sheets upon which has been deposited a material that imparts fragrance and/or antistatic properties to the fabric, usually by direct contact of the material to the fabric. While conventional dryer products are generally effective, they suffer from several drawbacks. For example, conventional dryer products typically are only useful for a single drying cycle and then must be discarded. Such limited use of the products results in an undesirable amount of waste of resources that is not environmentally friendly.

Further, while a conventional dryer product may be used for more than one drying cycle by a user attempting to be frugal or environmentally conscious, the conventional dryer product generally does not provide an indication to the user that the dryer product is no longer effective in imparting antistatic properties. Rather, a user who unknowingly uses ineffectual antistatic dryer products may be forced to re-dry the fabric in another drying cycle to minimize or eliminate static electricity.

Accordingly, it is desirable to provide a reusable dryer product. In addition, it is desirable to provide a fragrance-imparting and/or antistatic-imparting dryer product that provides an end-of-life indication that the product is no longer effective in imparting properties to fabric as desired. It also is desirable to provide a method for fabricating such dryer products. Furthermore, other desirable features and characteristics will become apparent from the subsequent detailed description and the appended claims, taken in conjunction with this background.

BRIEF SUMMARY

Dryer products for imparting desired properties onto fabric during multiple drying cycles in automated dryers and methods for fabricating dryer products are provided herein. In an exemplary embodiment, a dryer product is provided for use during multiple drying cycles in a laundry dryer and includes a solid body comprising a polymeric material. The dryer product further includes an active compound in and/or on the solid body. The dryer product is configured to release the active compound during a selected number of drying cycles at a temperature of from about 40° C. to about 100° C. The solid body is configured to fray after the selected number of drying cycles to indicate end-of-life.

In accordance with another exemplary embodiment, a dryer product that imparts antistatic properties to fabric is provided. The dryer product includes a solid plastic body formed from a polymeric material that is configured to be removably placed within a drum of a dryer for contacting the fabric during a drying cycle. The dryer product further includes a compound within the solid plastic body. The compound comprises an antistatic agent configured to impart antistatic properties to the fabric upon contact with the fabric during the drying cycle. Further, the solid plastic body contains a sufficient amount of the compound such that the dryer product can be used for more than one drying cycle while still imparting antistatic properties to the fabric being dried so that static electricity produced during each drying cycle is no more than 10 kilovolts. The solid plastic body is configured to fray after the selected number of drying cycles to indicate end-of-life.

In accordance with another exemplary embodiment, a method is provided for fabricating a reusable dryer product configured to impart a fragrance onto a fabric during a selected number of drying cycles. The method includes heating a polymeric material into a pliable form. The fragrance is added to the pliable form. Then, the pliable form is cooled in a mold to form the reusable dryer product. The reusable dryer product is configured for removable placement within a drum of an automated dryer for contacting the fabric during the selected number of drying cycles, and is configured to fray after the selected number of drying cycles to indicate end-of-life.

BRIEF DESCRIPTION OF THE DRAWINGS

Embodiments of reusable dryer products with end-of-life indicators and methods for fabricating reusable dryer products with end-of-life indicators will hereinafter be described in conjunction with the following drawing figures, wherein like numerals denote like elements, and wherein.

DETAILED DESCRIPTION

The following detailed description is merely exemplary in nature and is not intended to limit the dryer products and methods for fabricating dryer products described herein. Furthermore, there is no intention to be bound by any expressed or implied theory presented in the preceding technical field, background or brief summary, or in the following detailed description.

The various embodiments contemplated herein relate to dryer products configured for use in multiple drying cycles in commercial or residential laundry dryers. The dryer products include a solid body, such as a solid plastic body formed of a polymeric material, that is configured to be removably placed within a drum of a dryer for contacting fabric during a drying cycle. The dryer products further include an active compound within the polymeric material. The active compound may be a fragrance, an antistatic agent, a fabric softening agent, a wrinkle reducer, a bleaching agent, a stain remover, and/or antibacterial, antimicrobial, antiviral, and/or hygienic materials, and the like, or combinations thereof. In an exemplary embodiment, the active compound comprises an antistatic agent and a fragrance configured to impart antistatic and fragrance properties to the fabric upon contact with the fabric during the drying cycle.

The dryer product is configured to release the active compound from the polymeric material during a selected temperature range of the drying cycles. For example, the dryer product may be configured to release the active compound at a temperature of from about 40° C. to about 100° C., or other typical temperature range of a drying cycle.

A sufficient amount of the compound is included in the polymeric material such that the dryer product can be used for more than one drying cycle while still imparting the desired properties to the fabric being dried. Further, the solid plastic body is configured to physically deteriorate, for example, fray, after a selected number of drying cycles to indicate end-of-life of the dryer product. As used herein, "end-of-life" of the dryer product is reached when the dryer product no longer holds a sufficient amount of the compound to impart the desired property to the fabric during a drying cycle. Typically, the dryer product can be used for drying cycles until a substantial amount or substantially all the compound has been released from the polymeric material.

Figure 1:
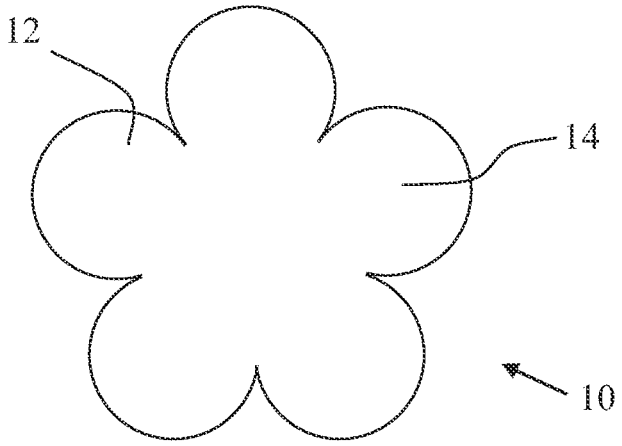
FIG. 1 is a front view of a reusable dryer product with an end-of-life indicator in accordance with an exemplary embodiment.

FIG. 1 illustrates a dryer product 10 in accordance with an exemplary embodiment. In FIG. 1, the dryer product is in the shape of a flower, though any aesthetic shape may be used. The dryer product 10 comprises a solid body 12 formed from a polymeric material such as an elastomeric material. For example, the material may be polyethylene or polypropylene though in certain embodiments the material is polyurethane, ethylene vinyl acetate, or polyether block amide. Polyurethane, ethylene vinyl acetate, and polyether block amide are believed to be more effective in the dryer product 10 as they have an amorphous micro-structure that facilitates release of molecules of the active compound as discussed below.

The dryer product 10 further includes an active compound 14 for imparting a desired property onto fabric. Depending on the desired use of the dryer product 10, the active compound 14 may be a fragrance, e.g., a scented oil or scented oils, an antistatic agent, a fabric softening agent, or another agent for imparting a desired property on to fabric. The active compound 14 may impart more than one property to fabric, for example, the compound may serve as both an antistatic agent and fabric softening agent. An exemplary antistatic agent includes a water soluble cationic surfactant. For example, in an exemplary embodiment, the active compound 14 comprises an alkoxylated fatty quaternary commercially available under the brand name ADOGEN® 66 from Evonik Industries of Essen, Germany. An exemplary dryer product 10 comprises less than about 15 weight percent (wt %) antistatic agent, for example about 1 wt % antistatic agent.

In an exemplary embodiment, the dryer product 10 alternatively or additionally includes a fragrance as the active compound. The fragrance may comprise one or more scented or fragrance oils, perfumes, or other alternatives known in the art. The dryer product 10 may include about 10 wt % to about 40 wt % fragrance, for example, the dryer product 10 may include about 30 wt % fragrance.

Figure 2:
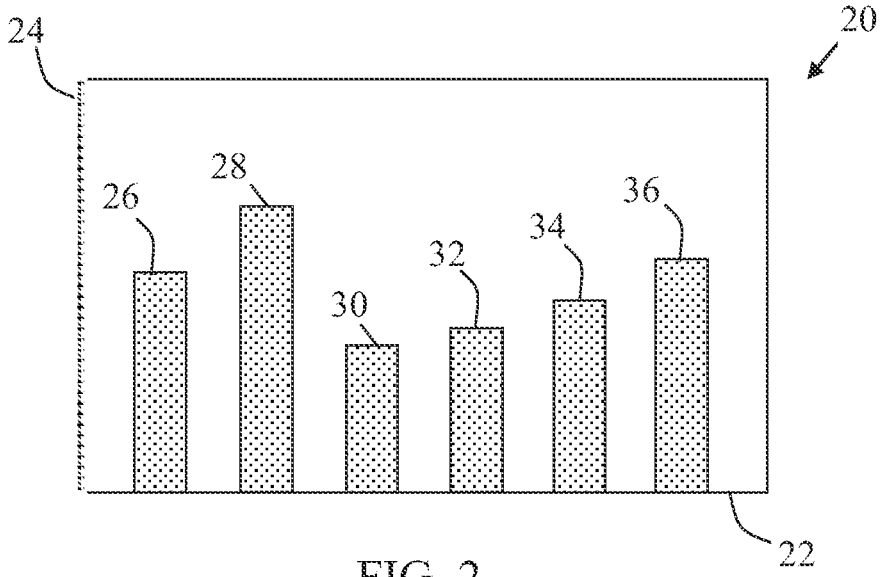
FIG. 2 is graph illustrating the antistatic properties of a dryer product in accordance with an exemplary embodiment.

FIG. 2 is a graph 20 illustrating the antistatic properties of a dryer product 10 initially including about 1 wt % antistatic agent and about 30 wt % fragrance. A static electricity test was performed to measure the voltage produced under a controlled dryer cycle using no dryer product or a dryer product after a selected number of cycles. The x-axis 22 represents six dryer cycle trials during which fabric was dried during a single drying cycle. The y-axis 24 represents the measure of static electricity created during those dryer cycle trials. Plot 26 shows the static electricity created during the drying of textiles without an antistatic dryer product (7.7 kilovolts). Plot 28 shows the static electricity created during the drying of fabric in a first cycle using the exemplary dryer product embodiment (9.61 kilovolts). Plot 30 shows the static electricity created during the drying of fabric in a second cycle (5.11 kilovolts), plot 32 shows the static electricity created during the drying of fabric in a sixth cycle (5.63 kilovolts), plot 34 shows the static electricity created during the drying of fabric in a sixteenth cycle (6.43 kilovolts), and plot 36 shows the static electricity created during the drying of fabric in twenty-first cycle (8.04 kilovolts), all using the exemplary dryer product embodiment. As shown, the dryer product imparts antistatic properties to the fabric being dried so that static electricity produced during each drying cycle is no more than 10 kilovolts.

In FIG. 2, the first cycle exhibits a higher amount of static electricity than the cycle without an antistatic agent. This is believed to result from an initial burn off of fragrance during the first cycle. Thereafter, until the twenty-first cycle, the dryer product successfully reduces static electricity. At the twenty-first cycle, the dryer product is no longer effective as it does not contain sufficient anti-static agent to reduce static electricity. In other words, the dryer product has reached its end-of-life. In FIG. 2, the drying product's end-of-life is after 20 drying cycles, however, the dryer product may be engineered to have shorter or longer end-of-life. In an exemplary embodiment, the end-of-life is reached at 20 or fewer drying cycles.

Testing was also performed to determine the effectiveness of the fragrance in the exemplary dryer product. Based on survey results, it was determined that the dryer product provided a more pleasing fragrance to fabric than a drying cycle without the exemplary dryer product for at least twenty drying cycles, though the fragrance provided lessened with additional cycles. An exemplary dryer product may be provided with sufficient fragrance to impart a desirable scent to the fabric for a selected number of dryer cycles. Thereafter, the dryer product may be considered to be at its end-of-life.

Figure 3:
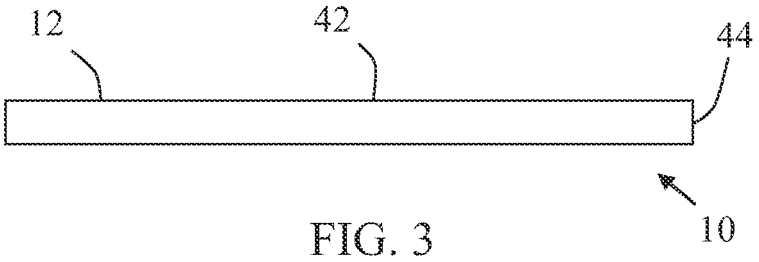
FIG. 3 is a cross sectional view of a dryer product in an initial state before use in a drying cycle in accordance with an exemplary embodiment.
Figure 4:
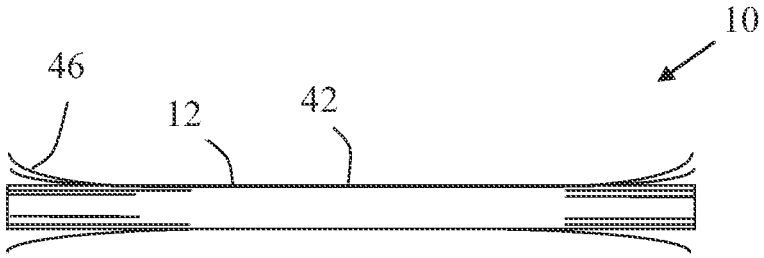
FIG. 4 is a cross sectional view of the dryer product of FIG. 3 after reaching an end-of-life state in accordance with an exemplary embodiment.

To indicate to users that the dryer product no longer imparts the desired property or properties to fabric during a drying cycle, i.e., that the dryer product has reached its end-of-life, the dryer product physically deteriorates. Cross-referencing FIGS. 3 and 4, an exemplary physical deterioration is shown. FIG. 3 is a cross-sectional view of the dryer product 10 is in its initial state before it has been used in a drying cycle. As shown, the solid body 12 of the dryer product 10 is substantially uniform and includes smooth top and bottom surfaces 42 and edges 44. Referring to FIG. 4, the dryer product 10 is shown after a selected number of drying cycles, such as after twenty drying cycles. As shown, the solid body 12 of the dryer product 10 is frayed—with laminar sheet-like portions 46 of the solid body 12 lifting away from the remainder of the surfaces 42. The physical deterioration representing end-of-life for the dryer product 10 may be defined to include a length of a laminar portion 46 separated from the remainder of the surfaces 42, as indicated by a measured length, e.g., one inch, or by a percentage of the length of a surface 42, e.g. 30%; a number of laminar portions 46 separated, such as three laminar portions 46 from one surface 42; a combination thereof; or other evidence of the physical deterioration of the solid body 12.

It is contemplated that the dryer product 10 physically deteriorates on time, i.e., upon reaching its end-of-life. Therefore, in an embodiment, the dryer product 10 neither physically deteriorates too early or too late. While the dryer product may exhibit some physical change as it endures successive drying cycles, it retains sufficient physical integrity which indicates that it still has active agent for further drying cycles. For example, the dryer product 10 may include the beginning of a laminar portion 46, but not a laminar portion long enough or not a sufficient number of laminar portions 46 to indicate the dryer product's end-of-life before the active agent is insufficient for use.

In an exemplary embodiment, the dryer product 10 has bright or noticeable color to facilitate locating the dryer product 10 among dried fabric or clothing. Such an exemplary dryer product 10 is colorfast and does not leave color marks on fabric or inside the automated dryer. Further, it is noted that color change is not a physical deterioration indicative of the dryer product end-of-life in this embodiment. The color is formed in the polymeric material and is not part of the active compound that contacts the fabric during a drying cycle.

Figure 5:
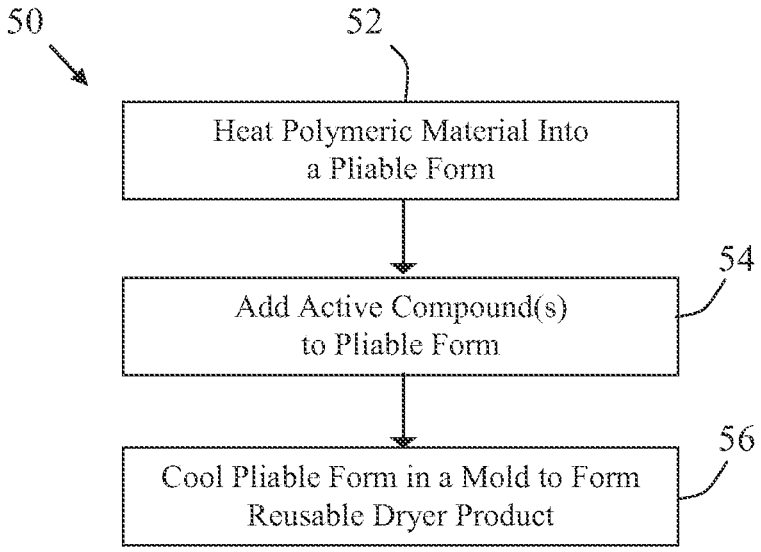
FIG. 5 is a flow chart illustrating a method for fabricating a dryer product in accordance with an exemplary embodiment.

FIG. 5 is a flowchart of a method 50 for fabricating a dryer product configured to impart a fragrance or antistatic properties, or other properties during a selected number of drying cycles with an end-of-life indicator in accordance with an exemplary embodiment. Generally, the method may be described as a thermoforming process in which an active compound or active compounds are added to the thermoplastic when it is in a pliable form. The method begins by heating a polymeric material into a pliable form (step 52). In an exemplary embodiment, the polymeric material is an elastomeric material such as polyethylene or polypropylene, and preferably is polyurethane, ethylene vinyl acetate, or polyether block amide. In an embodiment, the polymeric material is in the form of a thick gauge plastic sheet. Typically, the polymeric material is heated to a pliable, but not flowable form, so that it may be manipulated into a desired shape as is known in thermoforming processes.

The active compound (or active compounds) is then added to the pliable form (step 54). For example, fragrance in the form of a scented oil or scented oils or an antistatic agent is added to the pliable form. As a result, the active compound (or active compounds) is impregnated in the pliable form.

The method continues by cooling the pliable form in a mold to form the reusable dryer product (step 56). As a result, the dryer product is configured for removable placement within a drum of an automated dryer for contacting fabric during the selected number of drying cycles, and is configured to physically deteriorate after the selected number of drying cycles to indicate end-of-life.

Accordingly, dryer products for imparting fragrance and/or antistatic properties on to fabrics have been disclosed. Further, the dryer products are reusable for a selected number of drying cycles. Dryer products providing for an end-of-life indication when the dryer products are no longer effective in imparting the desired properties have been described.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the processes without departing from the scope defined by the claims, which includes known equivalents and foreseeable equivalents at the time of filing this patent application.

What is claimed is:

1. A dryer product for use during multiple drying cycles in a laundry dryer comprising:

a solid body comprising a polymeric material having laminar sheet-like portions;

an active compound in and/or on the solid body;

wherein the dryer product is configured to release the active compound during a selected number of drying cycles at a temperature of from about 40° C. to about 100° C.; and wherein the laminar sheet-like portions of the solid body are configured to fray after the selected number of drying cycles to indicate end-of-life.

2. The dryer product of claim 1 wherein the solid body is configured to be removably placed within a drum of the laundry dryer for contacting fabric during the drying cycles.

3. The dryer product of claim 1 wherein the active compound is fragrance, and wherein the dryer product comprises about 10 wt % to about 40 wt % fragrance.

4. The dryer product of claim 1 wherein the active compound is fragrance, and wherein the dryer product comprises about 30 wt % fragrance.

5. The dryer product of claim 1 wherein the active compound is an antistatic agent.

6. The dryer product of claim 5 wherein the antistatic agent comprises a water soluble cationic surfactant.

7. The dryer product of claim 5 wherein the solid body comprises less than about 15 wt % antistatic agent.

8. The dryer product of claim 5 wherein the solid body comprises about 1 wt % antistatic agent.

9. The dryer product of claim 1 wherein the solid body is configured to fray after about 20 or fewer drying cycles.

10. The dryer product of claim 1 wherein the polymeric material is polyurethane, ethylene vinyl acetate, or polyether block amide.

11. The dryer product of claim 1 wherein the solid body is formed by heating the polymeric material into a pliable form, adding the fragrance to the pliable form, and cooling the pliable form in a mold.

12. A dryer product that imparts antistatic properties to fabric comprising:

a solid plastic body formed from a polymeric material having laminar sheet-like portions, configured to be removably placed within a drum of a dryer for contacting the fabric during a drying cycle; and a compound within the solid plastic body, wherein the compound comprises an antistatic agent configured to impart antistatic properties to the fabric upon contact with the fabric during the drying cycle;

wherein the solid plastic body contains a sufficient amount of the compound such that the dryer product can be used for more than one drying cycle while still imparting antistatic properties to the fabric being dried so that static electricity produced during each drying cycle is no more than 10 kilovolts; and wherein the laminar sheet-like portions are configured to fray after a selected number of drying cycles to indicate end-of-life.

13. The dryer product of claim 12 further comprising a fragrance impregnated within the solid plastic body.

14. The dryer product of claim 13 wherein the solid plastic body comprises about 30 wt % fragrance.

15. The dryer product of claim 12 wherein the antistatic agent comprises a water soluble cationic surfactant.

16. The dryer product of claim 12 wherein the solid plastic body comprises less than about 15 wt % antistatic agent.

17. The dryer product of claim 12 wherein the solid plastic body comprises about 1 wt % antistatic agent.

18. The dryer product of claim 12 wherein the solid plastic body is configured to fray after about 20 or fewer drying cycles.

19. The dryer product of claim 12 wherein the polymeric material is polyurethane, ethylene vinyl acetate, or polyether block amide.

20. A method for fabricating a reusable dryer product configured to impart a fragrance onto a fabric during a selected number of drying cycles, the method comprising the steps of:

heating a polymeric material having laminar sheet-like portions into a pliable form;

adding the fragrance to the pliable form; and cooling the pliable form in a mold to form the reusable dryer product configured for removable placement within a drum of an automated dryer for contacting the fabric during the selected number of drying cycles, and configured to fray after the selected number of drying cycles to indicate end-of-life.

* * * * *